US007451672B2

(12) United States Patent
Junkers

(10) Patent No.: US 7,451,672 B2
(45) Date of Patent: Nov. 18, 2008

(54) LINK ATTACHMENT TO TORQUE WRENCH

(75) Inventor: Jason Junkers, Park Ridge, NJ (US)

(73) Assignee: JETYD Corp., Mahwah, NJ (US)

( * ) Notice: Subject to any disclaimer, the term of this patent is extended or adjusted under 35 U.S.C. 154(b) by 0 days.

(21) Appl. No.: 11/329,634

(22) Filed: Jan. 11, 2006

(65) Prior Publication Data

US 2007/0157768 A1 Jul. 12, 2007

(51) Int. Cl.
*B25B 13/46* (2006.01)
*B25B 13/58* (2006.01)

(52) U.S. Cl. ..... 81/57.39; 81/63; 81/180.1

(58) Field of Classification Search ..... 81/57.39, 81/57.36, 57.32, 180.1, 185, 62–63.2
See application file for complete search history.

(56) References Cited

U.S. PATENT DOCUMENTS 4,722,252 A * 2/1988 Fulcher et al. ..... 81/57.39
4,794,825 A 1/1989 Schmoyer
5,103,696 A * 4/1992 Beuke ..... 81/57.39
5,495,782 A 3/1996 Ruessmann et al.
6,330,842 B1 * 12/2001 Brun ..... 81/57.39
6,640,669 B2 * 11/2003 Izumisawa ..... 81/57.39
6,715,381 B2 * 4/2004 Junkers ..... 81/57.39
7,062,993 B2 * 6/2006 Shaw et al. ..... 81/57.39
7,121,167 B1 * 10/2006 Miner ..... 81/57.39
2003/0131691 A1 7/2003 Spirer
2004/0200320 A1 10/2004 Knopp et al.

FOREIGN PATENT DOCUMENTS

EP 0 432 884 6/1991
EP 0 555 967 8/1993

* cited by examiner

*Primary Examiner*—Hadi Shakeri
(74) *Attorney, Agent, or Firm*—Michael J. Striker

(57) ABSTRACT

A link attachment to a torque wrench providing coaxial action in the reaction turning forces in opposite directions at equal torque, the link attachment has a housing, a ratchet mechanism including a ratchet engageable with a fastener and a drive plate turning the ratchet, a first connecting structure for connecting the housing to a part of the torque wrench providing a reaction turning force and a second connecting structure for connecting a part of the torque wrench providing an action turning force for the at least one lever drive plate, so that a turning action of the torque wrench is converted into a linear action applied to the at least lever drive plate so as to turn the at least one lever drive plate and thereby to turn a fastener by the ratchet, while abutting against a nearby stationary object with the housing to stop the torque wrench from turning around the fastener to be tightened or loosened.

7 Claims, 4 Drawing Sheets

FIG. 3
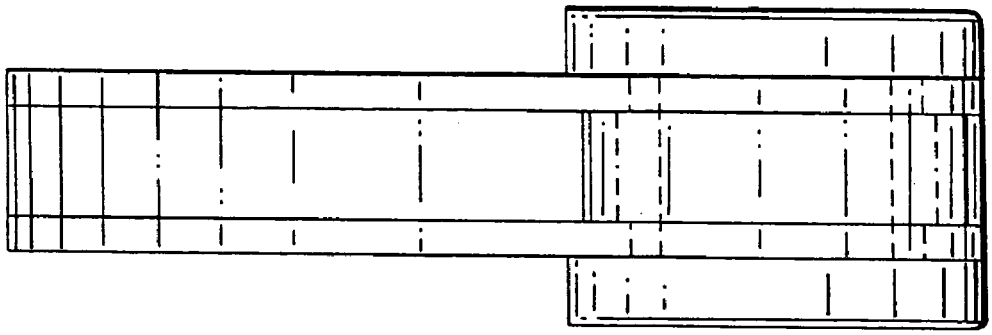
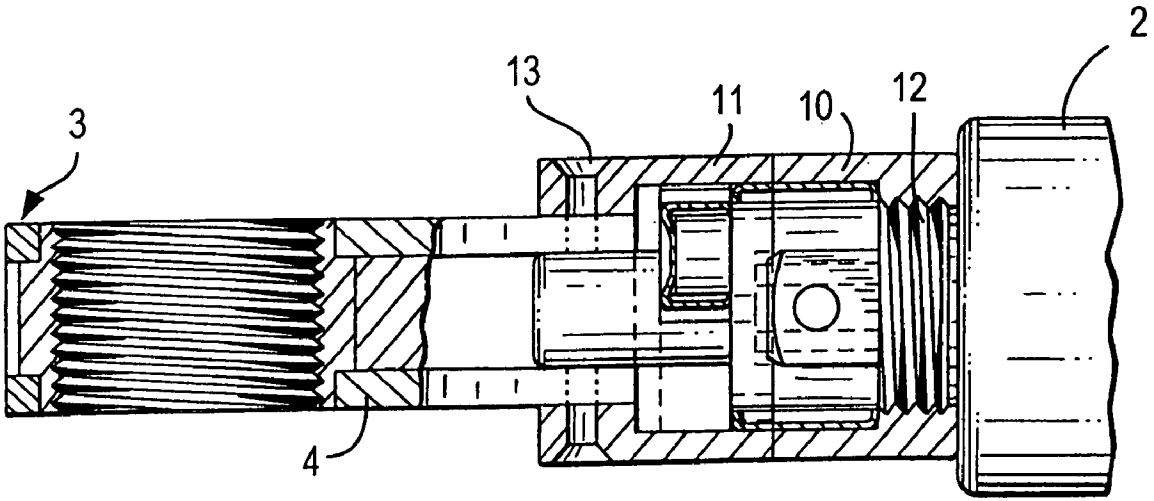
FIG. 2

LINK ATTACHMENT TO TORQUE WRENCH

CROSS-REFERENCE TO A RELATED APPLICATION

This application contains a subject matter which is similar to the subject matter of a copending patent application Ser. No. 11/273,429 filed on Nov. 14, 2005.

BACKGROUND OF THE INVENTION

The present invention relates to link attachments for torque wrenches.

Link attachments for torque wrenches usually carry a pawl-ratchet mechanism for tightening and loosening of threaded connectors. They are known in many different embodiments as disclosed in issued patents and used in various industries.

It is believed that the existing link attachments can be further improved.

SUMMARY OF THE INVENTION

Accordingly, it is an object of the present invention to provide a link attachment for a torque wrench, which is a further improvement of the existing link attachments for a torque wrench.

In keeping with these objects and with others which will become apparent hereinafter, one feature of the present invention resides, briefly stated, in a link attachment to a torque wrench providing coaxial action and reaction turning forces in opposite directions at equal torque, said link attachment comprising a housing; a ratchet mechanism including a ratchet engageable with a fastener and at least one lever drive plate turning said ratchet; first connecting means for connecting said housing to a part of the torque wrench providing a reaction turning force and second connecting means for connecting a part of the torque wrench providing an action turning force for said at least one lever drive plate, so that a turning action of the torque wrench is converted into a linear action applied to said at least lever drive plate so as to turn said at least one lever drive plate and thereby to turn a fastener by said ratchet, while abutting against a nearby stationary object with said housing to stop the torque wrench from turning around the fastener to be tightened or loosened.

When the link attachment is designed in accordance with the present invention, it allows in a simple and efficient way to turn a threaded connector, and at the same time to counteract a reaction force by abutting against a neighboring object, for example a further threaded connector.

In accordance with a further feature of the present invention, said second connecting means include an element which under the action of turning of the torque wrench displaces linearly and is connected to an end of said at least one lever drive plate, which end is opposite to said ratchet.

In accordance with still another feature of the present invention, said second connecting means is formed so that said conversion from the turning action to the linear action multiplies a torque input of the torque wrench to increase a torque output by said ratchet to the fastener, so that the reaction turning force of the torque wrench which tries to tilt the link attachment is overcome by action and reaction forces of the link attachment which are superior and also perpendicular to the action and reaction turning forces of the torque wrench, so that the link attachment remains in line with the fastener to be turned and the nearby stationary object.

In accordance with a further feature of the present invention, said second connecting means has an element such that, said element and said at least one lever drive plate are formed so that a ratio of the linear displacement of said element to an active length of said at least one lever drive plate provides the multiplication of the torque input of the torque wrench to increase the torque output to the fastener.

In accordance with still a further feature of the present invention, a switching means is provided so that during tightening of the fastener said ratchet turns the fastener in a predetermined direction, and for tightening the nearby object also formed as a fastener, the link attachment is turned over and said ratchet turns the further fastener also in the same direction, while simultaneously a turning direction of said ratchet is changed when going from the tightening of the first mentioned fastener to the tightening of said further fastener.

In accordance with an additional feature of the present invention, said switching means include a pawl engageable with said ratchet and an actuating element acting on said pawl so that said pawl engages said ratchet in two different modes providing turning of said ratchet in two opposite directions.

In accordance with a further feature of the present invention, said actuating element includes a pin which defines an axis of turning of said pawl and moves between two positions that determines said two different modes.

The novel features which are considered as characteristic for the present invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS

FIGS. 1, 2, and 3 are a front view, a top view and a side view of a link attachment to a torque wrench in accordance with the present invention;

DESCRIPTION OF THE PREFERRED EMBODIMENTS

Figure 1:
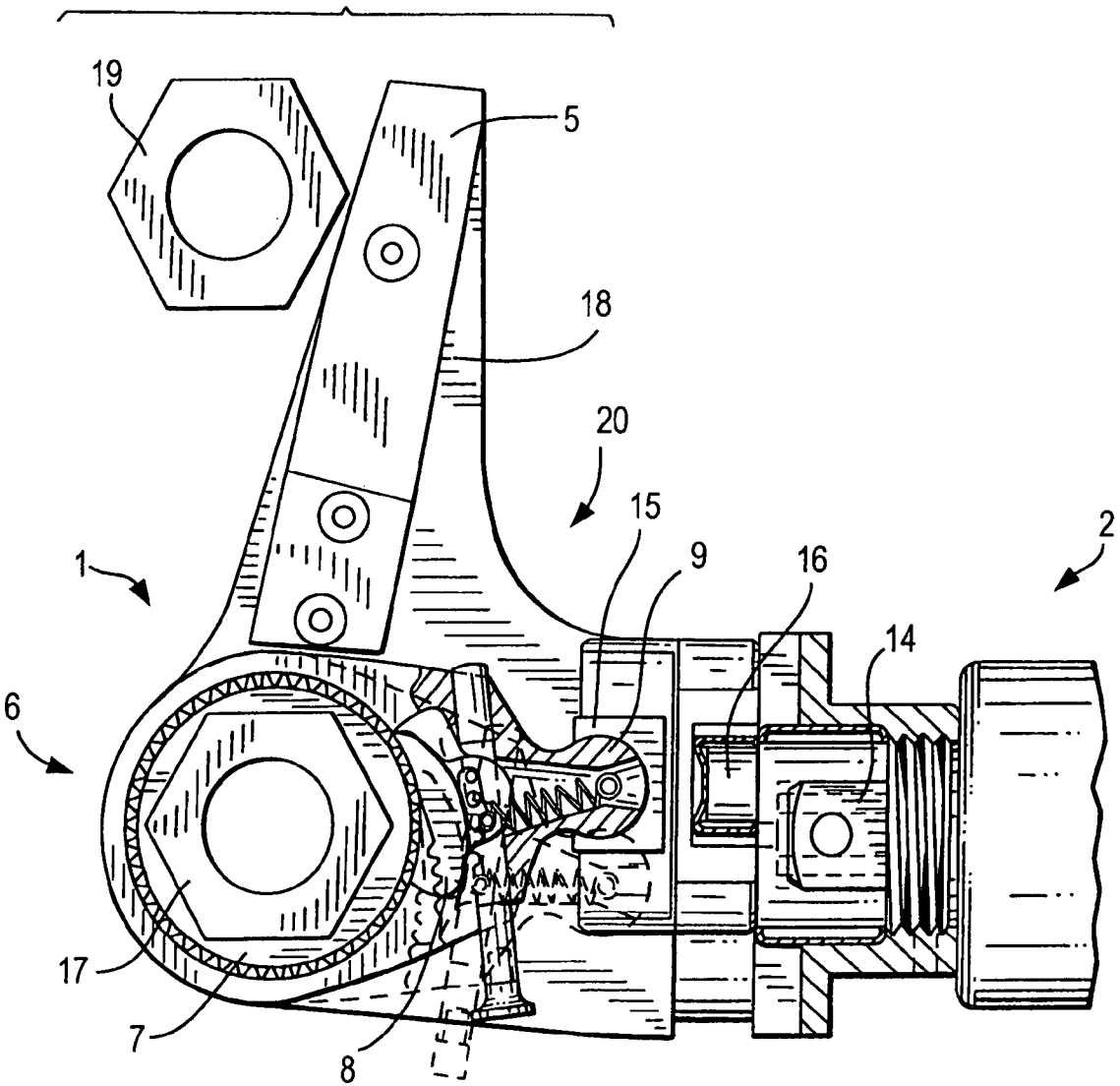

A link attachment in accordance with the present invention is identified with reference numeral 1 and is provided for attachment to a torque wrench which is identified with reference numeral 2.

The link attachment 1 has a housing which is identified with reference numeral 3 and can include housing plates 4 spaced from one another for example by a spacer 5, connected with one another, and supporting corresponding parts of the link attachment. The link attachment further has ratcheting means which is identified with reference numeral 6 and has a ratchet 7 turnably supported in the housing 3, a pawl 8 cooperating with the ratchet 4 by engagement with the teeth of the latter, and at least one lever drive plate 9 which carries the pawl 8 and is turnable around an axis of the ratchet 7.

First connecting means are provided for connecting the housing 3 of the link attachment 1 to the torque wrench 2. The first connecting means can be formed for example as two flanges 10 and 11. The flange 10 is non-rotatably connected to a non-rotatable projection 12 extending, for example, from the housing of the torque wrench, while the flange 11 is non-rotatably connected with the flange 10, for example, by bolts and is also non-rotatably connected to the housing 3 or more particularly to the housing plates 4 by bolts extending through openings 13 of the flange 11. During the operation the housing of the link attachment can not turn therefore relative to the housing of the torque wrench.

The link attachment is provided with second connecting means which are connected with a rotatable part of the torque wrench, for example with its spindle 14 and convert the turning movement of the spindle 13 into a linear displacement of a an element 15 of a link attachment. The second connecting means can include a crank 16 having one leg seated on the spindle 14 of the torque wrench, and another offset leg which is connected with the element 15 so as to provide its transverse linear movement in an opening of the housing 3 transversely to the axis of turning of the crank element. The element 15 which is formed, for example, as a slider is connected with an end of the drive plate 9 of the ratchet mechanism 6, which end is opposite to the ratchet 7.

During the operation the ratchet 7 is fitted with is central opening or a socket on a fastener and the torque wrench is activated, the rotation of the spindle 14 of the torque wrench 2 is converted into a transverse linear movement of the element 15, which provides turning of the lever drive plate 9 around an axis of the ratchet. During this turning of the lever drive plate the pawl 8 that is mounted on the drive plate and engages with the teeth of the ratchet 7 turns the ratchet 7, which ratchet thereby turns the fastener 17 so as to tighten or loosen the latter. During this process the projecting part 18 of the housing of the link attachment abuts against a nearby stationary object 19, which can be also formed as a fastener, such as a nut and the like.

Figure 4:
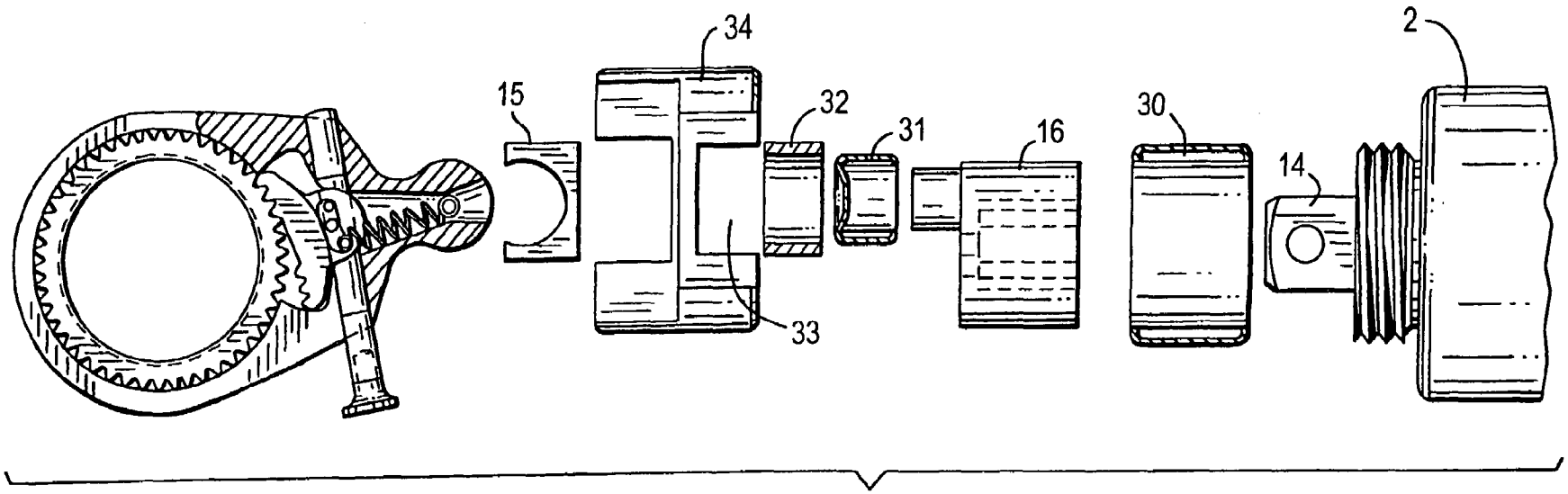
FIG. 4 is an exploded view of a connection between the link attachment and the torque wrench in accordance with the present invention.

FIG. 4 shows components which are provided for conversion of the rotary movement of the torque wrench into the linear movement. The components include a bearing 30 which receives the spindle 14 of the torque wrench 2 and is installed in the flange 10, the crank 16 whose projecting offset part is arranged in a bearing 31 arranged on the offset pin of the crank 16, a bushing 32 fitted on the bearing 31 and located in a slot 33 of a crosshead 34, and the element 15 located in the opposite slot of the crosshead 34.

Figure 6:
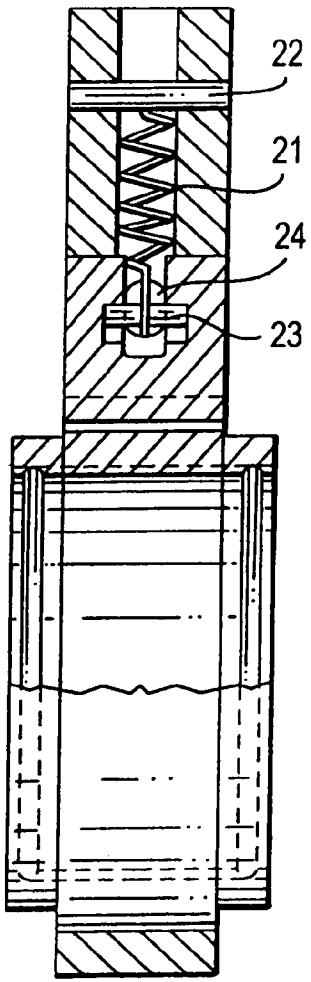
FIGS. 5 and 6 are a front view and a side view of a switching mechanism of the inventive link attachment
Figure 5:
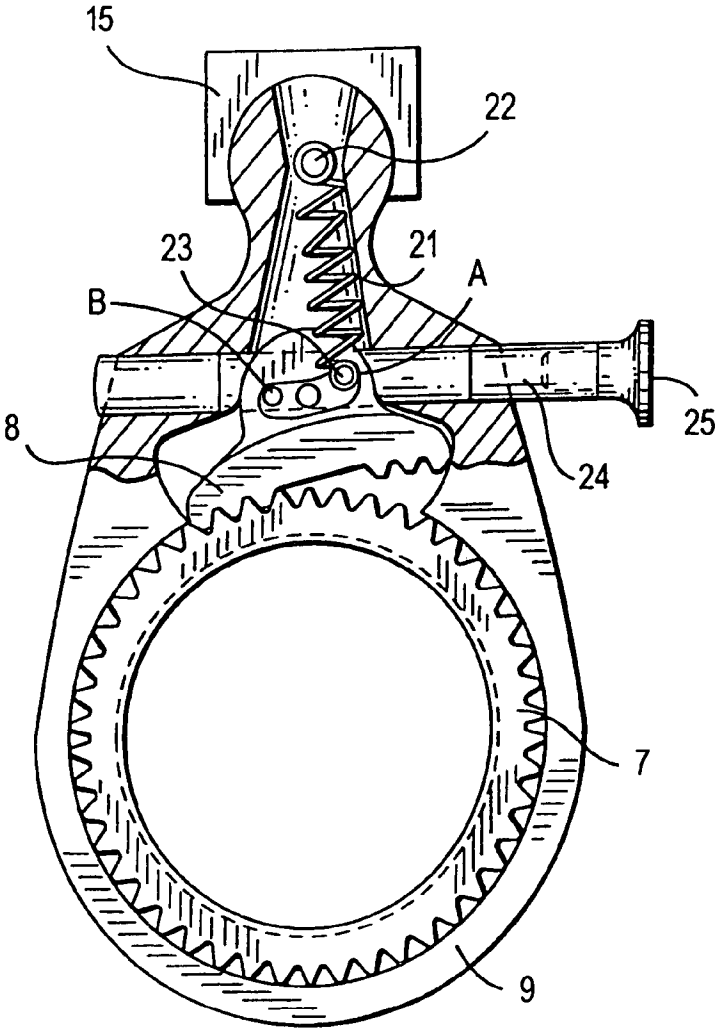

The link attachment is further provided with a switching mechanism shown in FIGS. 5 and 6 and identified as a whole with reference numeral 20. The switching mechanism is designed in the following manner.

The pawl 8 pivots on a radius in the lever drive plate 9. A tension spring 21 is connected between pins 22 and 23. The pawl 8 can be formed as a two-pawl structure, etc. The pawl 8 has a groove which allows a pin 23 to be moved between a position A and a position B by a switch pin 24, so as to reverse the action of the pawl. In each position A or B the pin 23 defines an axis of turning of the pawl 8. A pawl knob 25 is used to pull the switch pin 24.

When the pawl 8 is in the position A, it engages the ratchet 7 by one end and provides its turning in a predetermined direction, for tightening or loosening the nut 17. After the nut 17 has been tightened or loosened, and it is necessary to tighten or loosen the neighboring nut 19, the link attachment with the power tool is turned over and the ratchet 7 is applied onto the nut 19. By actuating the reversing pin 24, the pin 23 inside the pawl 8 moves to another position B. When now the power tool is activated, the ratchet 7 is turned in an opposite direction to drive the neighboring nut 19 in the same direction in which the nut 17 was turned before to tighten or loosen the nut 19.

The term "the same direction" is used to indicate that both nuts 17 and 19 have to be turned in the same direction for tightening and they also had to be turned in the same direction for loosening, while the directions of tightening and loosening are opposite.

In accordance with the present invention, the conversion from the turning action of the spindle 14 of the torque wrench 2 into the linear action provides a multiplication of the torque input of the torque wrench to increase the torque output to the fastener. For this purpose the distance between the center of the ratchet or of the opening in the lever drive plate 9 and the point of pivoting of the lever drive plate is several times greater than the linear transverse displacement of the element 15, thus providing the above identified multiplication.

The action and reaction forces of the link attachment are perpendicular to the action and reaction forces of the torque wrench, so that the link attachment remains in line with the nut 17 to be turned and with the nut 19 to be reacted upon.

It will be understood that each of the elements described above, or two or more together, may also find a useful application in other types of constructions differing from the types described above.

While the invention has been illustrated and described as embodied in a link attachment, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

The invention claimed is:

1. A link attachment to a torque wrench providing coaxial action and reaction turning forces in opposite directions at equal torque, said link attachment comprising a link housing; means for abutting against a nearby stationary object and including a projecting part provided in the link attachment and abuttable against a nearby stationary object; means for turning a fastener and supported in said link housing and including a ratchet mechanism with a ratchet provided in the link attachment and engageable with a fastener to turn the latter and at least one lever drive plate turning said ratchet; first connecting means provided in the link attachment for connecting said link housing to a part of the torque wrench providing a reaction turning force and second connecting means provided in the link attachment for connecting a part of the torque wrench providing an action turning force for said at least one lever drive plate of the link attachment, so that a turning action of the torque wrench is converted into a linear action applied to said at least lever drive plate of the link attachment so as to turn said at least one lever drive plate and thereby to turn a fastener by said ratchet, while abutting against a nearby stationary object with the projecting part of the link attachment to stop the torque wrench from turning around the fastener to be tightened or loosened so that the link attachment provides simultaneously turning of the fastener and stopping of the torque wrench from turning around the fastener; switching means for switching a turning direction of said ratchet and arranged so that during tightening of the fastener said ratchet of the link attachment turns the fastener in a predetermined direction, and for tightening the nearby object also formed as a fastener, the link attachment is turned over and said ratchet also turns said further fastener in the same direction, while simultaneously a turning direction of said ratchet of the link attachment is changed when going from the tightening of the first mentioned fastener to the tightening of the further fastener, wherein said switching means of the link attachment include a pawl engageable with said ratchet and an actuating element acting on said pawl so that said pawl engages said ratchet in two different modes that provide turning of said ratchet in two opposite directions, wherein said actuating element defines an axis of turning of said pawl, which axis of turning of said pawl is parallel with a turning axis of the fastener, and moves between two positions that determine said two different modes, wherein said actuating element includes a pin which defines the axis of turning of said pawl, and wherein said pawl has a groove and said pin being movable within said groove between the two positions by said actuating element.

2. A link attachment as defined in claim 1, wherein said second connecting means include an element provided in the link attachment and which under the action of the turning of the torque wrench displaces linearly and is connected to an end of said at least one lever drive plate of the link attachment, which end is opposite to said ratchet of the link attachment.

3. A link attachment as defined in claim 1, wherein said second connecting means of the link attachment is formed so that said conversion from the turning action to the linear action multiplies a torque input of the torque wrench to increase a torque output by said ratchet of the link attachment to the fastener, so that the reaction turning force of the torque wrench which tries to tilt the link attachment is overcome by action and reaction forces of the link attachment which are superior and also perpendicular to the action and reaction turning forces of the torque wrench, so that the link attachment remains in line with the fastener to be turned and the nearby stationary object.

4. A link attachment as defined in claim 3, wherein said second connecting means has an element, wherein said element and said at least one lever drive plate of the link attachment are formed so that a ratio of the linear displacement of said element to an active length of said at least one lever drive plate of the link attachment provides the multiplication of the torque input of the torque wrench to increase the torque output to the fastener.

5. A link attachment as defined in claim 1, wherein the link attachment is connectable to and disconnectable from the torque wrench as a unit.

6. A link attachment as defined in claim 1, wherein said first connecting means is configured for connecting the link housing with the projecting part configured for abutting against a nearby stationary object to the part of the torque wrench which is a housing of the torque wrench, while said second connecting means is configured to connect the part of the torque wrench which is formed as a driving spindle to the lever drive plate of the link attachment.

7. A link attachment as defined in claim 1, wherein said second connecting means include a crank having one leg seated on the part of the torque wrench providing an action turning force, and another offset leg which is connected with an element which performs a transverse linear movement and is connected to said drive plate.

* * * * *